US008948629B2

(12) United States Patent
Ozeki

(10) Patent No.: US 8,948,629 B2
(45) Date of Patent: Feb. 3, 2015

(54) IMAGE FORMING APPARATUS AND IMAGE FORMING METHOD

(71) Applicant: Oki Data Corporation, Tokyo (JP)

(72) Inventor: Fumitaka Ozeki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/796,712

(22) Filed: Mar. 12, 2013

(65) Prior Publication Data

US 2013/0251386 A1 Sep. 26, 2013

(30) Foreign Application Priority Data

Mar. 26, 2012 (JP) ..... 2012-070097

(51) Int. Cl.

| | |
|---|---|
| ***G03G 15/02*** | (2006.01) |
| ***G03G 15/16*** | (2006.01) |
| ***G03G 21/00*** | (2006.01) |
| ***G03G 21/20*** | (2006.01) |

(52) U.S. Cl.

CPC ..... *G03G 15/0258* (2013.01); *G03G 15/1675* (2013.01); *G03G 21/0011* (2013.01); *G03G 21/20* (2013.01)

USPC ..... 399/44; 399/66

(58) Field of Classification Search

CPC combination set(s) only.

See application file for complete search history.

(56) References Cited

U.S. PATENT DOCUMENTS 5,276,483 A * 1/1994 Hasegawa et al. ..... 399/44
6,148,159 A * 11/2000 Shiraishi ..... 399/44

FOREIGN PATENT DOCUMENTS

| | | | |
|---|---|---|---|
| JP | 2003-302883 | A | 10/2003 |
| JP | A-2004-045481 | | 2/2004 |
| JP | 2006-119329 | A | 5/2006 |
| JP | 2009-265491 | A | 11/2009 |
| JP | A-2011-123521 | | 6/2011 |

* cited by examiner

*Primary Examiner* — Clayton E Laballe
*Assistant Examiner* — Jas Sanghera
(74) *Attorney, Agent, or Firm* — Muncy, Geissler, Olds & Lowe, P.C.

(57) ABSTRACT

An image forming apparatus includes image carrier carrying latent image, developer carrier supplying developer on the image carrier, transfer part transferring the developer on the image carrier, cleaning blade removing attachment that attaches to a surface of the image carrier, internal environment detection part detecting an internal environmental temperature in the apparatus, developer disposal control part controlling disposal of developer from the developer carrier to the image carrier, and voltage control part controlling an applied voltage to the transfer part. Wherein, the developer disposal control part determines an absolute value of the applied voltage larger, which is applied to the transfer part during disposing the developer, where the internal environment temperature is high, and the voltage control part controls the applied voltage to the transfer part based on the absolute value of the voltage decided by the developer disposal control part.

15 Claims, 9 Drawing Sheets

IMAGE FORMING APPARATUS AND IMAGE FORMING METHOD

CROSS REFERENCE TO RELATED APPLICATION

The present application is related to, claims priority from and incorporates by reference Japanese Patent Application No. 2012-070097, filed on Mar. 26, 2012.

TECHNICAL FIELD

The present invention relates to an image forming apparatus that uses an electrographic method, such as a, printer, a photocopy apparatus and the like and an image forming method.

BACKGROUND

A conventional image forming apparatus that uses an electrographic method is disclosed in JP Laid-Open Patent Application No. 2004-045481. The image forming apparatus includes a photosensitive drum, a charge device, an exposure device, a development device, a transfer device and a photosensitive body cleaning device. In the image forming apparatus, a surface of the photosensitive drum evenly charged by the charge device is exposed by the exposure device to form an electrostatic latent image. And then, the electrostatic latent image is developed by the development device to form a toner image on the photosensitive drum. After that, the toner image is transferred to a sheet by the transfer device, and is fixed on the sheet by the fuser device. After the toner image has been transferred, toner on the photosensitive drum is removed by the photosensitive body cleaning device.

In such an electrographic image forming apparatus, a toner disposal operation is performed to prevent problems such as unevenness of a print image density, decrease of dot reproduction, drum filming, fog and the like. That is, the toner is disposed to the photosensitive drum, and is collected by photosensitive body cleaning device when a consumption amount of the toner is equal to or less than a reference value.

However, pass-through of the toner easily occurs according to temperature in the apparatus. Herein, the pass-through is defined as follows: basically, toner disposed on the photosensitive drum is subject to be eliminated from the drum with a cleaning blade. However, some of the toner may go through between the blade and the photosensitive drum so that the toner remains on the surface of the drum. The phenomenon is defined the pass-through in the application.

One of objects of specific examples illustrated in the present invention is to reduce the pass-through of toner.

SUMMARY

Considering the above objects, an image forming apparatus is provided, which includes an image carrier configured to carry a latent image, a developer carrier configured to supply developer on the image carrier, a transfer part configured to transfer the developer on the image carrier, a cleaning blade configured to remove attachment that attaches to a surface of the image carrier, an internal environment detection part configured to detect an internal environmental temperature in the apparatus, a developer disposal control part configured to control disposal of developer from the developer carrier to the image carrier, and a voltage control part configured to control an applied voltage to the transfer part. Wherein, the developer disposal control part determines an absolute value of the applied voltage larger, which is applied to the transfer part during disposing the developer, where the internal environment temperature is high in comparison with where the internal environment temperature is low, and the voltage control part controls the applied voltage to the transfer part based on the absolute value of the voltage decided by the developer disposal control part.

In another view, an image forming method is provided, which includes disposing developer from a developer carrier that carries the developer to an image carrier that faces the developer carrier. The disposing includes detecting internal apparatus temperature in an apparatus, determining an absolute value of a voltage, which is applied to a transfer part that faces the image carrier, according to the internal apparatus temperature detected in the detecting, controlling the voltage applied to the transfer part based on the absolute value of the voltage determined in the determining.

The frequency of pass-through and the amount of the toner, which passes through, are reduced in the specific examples illustrated in the present invention.

DESCRIPTION OF EMBODIMENTS

Embodiments of the present invention are explained below with reference to the accompanying drawings.

In the invention according to the present embodiment, toner disposed from a development roller to a photosensitive drum is transferred to a transfer side at high temperature to prevent pass-through of the toner during cleaning the drum. When temperature becomes high, a toner cleaning ability of a cleaning blade decreases. At the time, like waste toner, when a great amount of toner reaches the cleaning blade, the toner is not cleaned, and the pass-through occurs. The toner disposed on the drum is carried to the transfer side, and is collected in a transfer belt cleaning device since the phenomenon (or the pass-through) more frequently occurs when the temperature is high. At this time, an amount of toner is controlled to be more transferred to the transfer side as the temperature becomes high.

As described above, in the present invention, the disposed developer is transferred to the transfer part at high temperature. Specifically, the toner is more carried onto a transfer belt as the temperature becomes high. Therefore, a transfer voltage is raised as the temperature becomes high. A specific configuration is explained below.

First Embodiment

An image forming apparatus and an image forming method according to the first embodiment are explained.

[Image Forming Apparatus]

Figure 1:
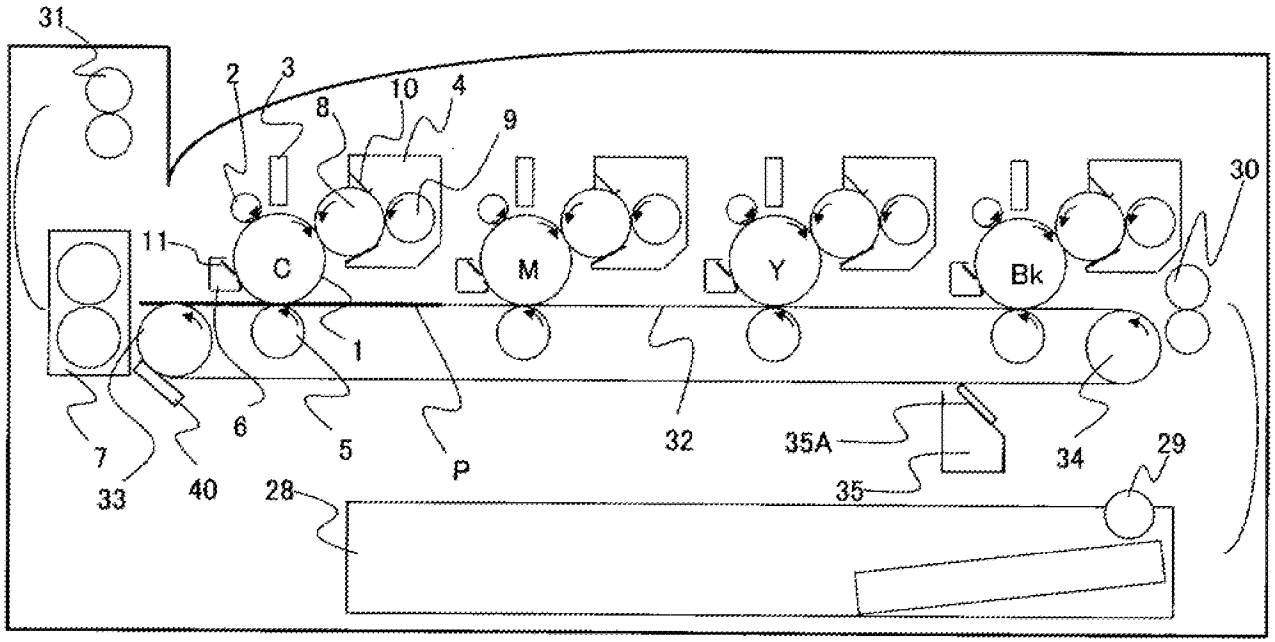
FIG. 1 is a configuration diagram of an image forming apparatus according to a first embodiment of the present invention.

FIG. 1 is a configuration diagram of the image forming apparatus according to the first embodiment. The image forming apparatus according to the present embodiment is configured by development units, a fuser 7, a tray 28, a hopping roller 29, registration rollers 30, ejection rollers 31, a transfer belt 32 (transfer cleaning member), a drive roller 33, an idler roller 34 and a belt cleaning device 35. The number of the development units corresponds to the number of colors of toners, black (BK), yellow (Y), magenta (M) and cyan (C). The fuser 7 is arranged on a carrying path of recording mediums P. The tray 28 accommodates the recording mediums P. The hopping roller 29 picks up each of the recording mediums P from the tray 28. The registration rollers 30 carry the recording medium P without skewing. The ejection rollers 31 eject the recording medium P out of the apparatus. The transfer belt 32 carries the recording medium P and transfers the developer. The drive roller 33 drives the transfer belt 32. The idler roller 34 stabilizes drive of the transfer belt 32. The belt cleaning device 35 cleans the toner on the transfer belt 32.

A temperature sensor 40 that is in contact with the transfer belt 32 is provided in the vicinity of the drive roller 33. The temperature sensor 40 is a temperature detection part and an internal environment detection part that detects a physical value of an environment in the apparatus. Here, the temperature sensor 40 measures internal environmental temperature in the apparatus as a physical value. Specifically, the temperature sensor 40 detects temperature of the transfer belt 32 as internal apparatus temperature in the image forming apparatus. Instead of directly measuring temperature of the surface of a photosensitive drum 1, the temperature of the transfer belt 32 is measured to indirectly measure the temperature of the surface of the photosensitive drum 1 since it is difficult to directly measure the temperature of the surface photosensitive drum 1. The temperature measured by the temperature sensor 40 is added to temperature obtained by considering various conditions such as a heat transfer degree of the transfer belt 32 and the like to specify the surface temperature of the photosensitive drum 1.

Each of the development units is configured by the photosensitive drum 1, a charging roller 2 arranged on the periphery of the photosensitive drum 1, an LED (Light Emitting Diode) head 3, a development unit 4, a transfer roller 5 and a photosensitive body cleaning device 6.

The photosensitive drum 1 is an image carrier that carries a latent image. The photosensitive drum 1 is formed of an electric charge generation layer having a film thickness of 0.5 μm and an electric charge transport layer having a film thickness of 18 μm provided on an aluminum tube having a thickness of 0.75 mm and an outside diameter of 30 mm.

The charging roller 2 is a charging member that charges the surface of the photosensitive drum 1. The charging roller 2 is a device for evenly charging the surface of the photosensitive drum 1. The charging roller 2 is configured, for example, a conductor made of steel special use stainless (SUS) member as a shaft and a conductive elastic body such as epichlorohydrin and the like. The conductor is covered by the conductive elastic body. The charging roller 2 is arranged to contact the photosensitive drum 1.

The LED head 3 is an exposure device (exposure part) that selectively exposes the uniformly charged surface of the photosensitive drum 1 to light thereof, thereby forming a latent image pattern on the surface of the photosensitive drum 1. The LED head 3 is configured from LED elements, LED drive elements, and a lens array. The LED head 3 is arranged at a position in which light radiated by the LED elements forms an image on the surface of the photosensitive drum 1.

The development unit 4 is a device for developing the latent image pattern formed on the photosensitive drum 1 to form a toner image. The development unit 4 is configured from a development roller 8 as a developer carrier, a supply roller 9 as a supply member and a restriction blade 10 as a layer restriction part. The development roller 8 uses the toner as the developer on the photosensitive drum 1 to develop the latent image pattern. The supply roller 9 is arranged to contact the development roller 8, and supplies the toner on the development roller 8. The restriction blade 10 is arranged so that a front edge part thereof abuts on the development roller 8. The inside of the development unit 4 is configured in which the toner is refilled form a toner cartridge as a developer container (not illustrated). The development roller 8 in the development unit 4 is arranged at a position in which the development roller 8 contacts the surface of the photosensitive drum 1.

The development roller 8 is configured by a conductive shaft (core) made of a SUS material, an elastic layer arranged on the conductive shaft in a roll shape and a surface layer covering the elastic layer. The elastic layer is made of urethane rubber or silicone rubber. The surface layer is made by treating a surface of the elastic layer with urethane solution, or by applying acrylic resin, acrylic-fluoro copolymer resin on the surface of the elastic layer. Carbon black is compounded into the surface layer made of the acrylic resin or acrylic-fluoro copolymer resin to impart the conductivity to the surface layer.

The supply roller 9 is formed of a conductive shaft (core) made of a SUS material, and an elastic layer. The elastic layer is conductive silicone rubber foam layer or a conductive urethane rubber foam layer. Acetylene black, carbon black or the like is added when the elastic layer has a semi-conductive property.

The restriction blade 10 is configured by a SUS material having a thickness of 0.08 mm. The restriction blade 10 includes a contact part that contacts the development roller 8, and the contact part undergoes a bending process to form a curvature part having a curvature radius R of 0.2 mm. The restriction blade 10 has a linear pressure of 30 gf/cm with respect to the development roller 8. The curvature radius R and the linear pressure of the restriction blade 10 are not limited to the above-described values, but are adjustable according to the amount and the charge amount of the toner on the development roller 8.

The transfer roller 5 is a transfer member that transfers the developer on the image carrier onto the recording medium P or the transfer belt 32. The transfer roller 5 transfers the toner image formed on the photosensitive drum 1 to the recording medium P, or the transfer belt 32. The transfer roller 5 is, for example, formed of a foam elastic member having a conductive property. A transfer section that includes the transfer roller 5 and the transfer belt 32, the drive roller 33 and the idler roller 34 are included in a transfer unit. In addition, the transfer unit and the belt cleaning device 35 are included in a belt unit (transfer part). The belt cleaning device 35 removes attachment (toner) that attaches onto the transfer belt 32 with a belt cleaning blade 35A, and collects the removed attachment.

The photosensitive body cleaning device 6 removes attachment (toner) that attaches on the surface of the image carrier and collects the removed attachment. That is, the photosensitive body cleaning device 6 is a device for scraping off and disposing toner that has not been transferred and remains on the photosensitive drum 1 and waste toner transferred from the development unit 4 onto the photosensitive drum 1. The photosensitive body cleaning device 6 is configured by the cleaning blade 11 made of rubber, for example. A front edge part of the cleaning blade 11 of the photosensitive body cleaning device 6 is arranged to abut on the surface of the photosensitive drum 1. Table 1 illustrates physical property values of the cleaning blade 11 used in the present embodiment.

TABLE 1

| Property Values of Cleaning Blade | |
|---|---|
| Hardness (JIS-A) | 75 |
| 100% Modulus (kgf/cm$^2$) | 42 |
| 200% Modulus (kgf/cm$^2$) | 70 |
| 300% Modulus (kgf/cm$^2$) | 128 |
| Tensile Strength (kgf/cm$^2$) | 750 |
| Extension (%) | 457 |
| Tearing Strength (JIS-B type, kgf/cm) | 58.6 |
| Tensile Elasticity (kgf/cm$^2$) | 76.3 |
| Permanent Extension (200% Extension × 10 minutes, %) | 3.9 |
| Rebound Resilience (%) 23° C. | 49 |
| tan σ Peak Temperature (° C.) | −4 |

The fuser 7 is a device for fixing the toner image transferred onto the recording medium P by applying heat and pressure.

Figure 2:
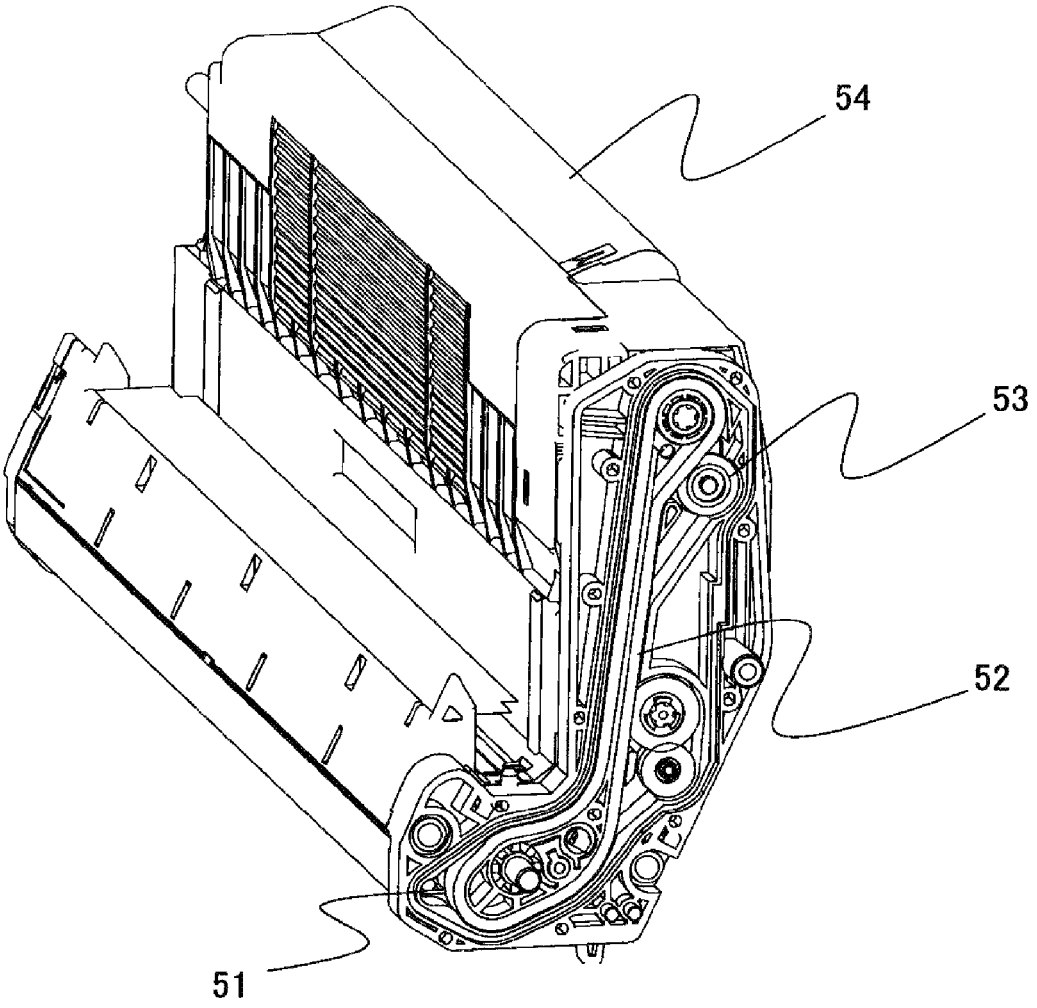
FIG. 2 is a perspective view of a waste toner collection mechanism according to the first embodiment of the present invention.

FIG. 2 is a perspective view of a waste toner collection mechanism. The waste toner collection mechanism is provided to be adjacent to the photosensitive body cleaning device 6. The waste toner collection mechanism is configured with a spiral 51, a waste toner carrying belt 52, a waste toner carrying spiral 53 and a waste toner collection box 54. The waste toner removed by the photosensitive body cleaning device 6 is carried to an endless waste toner carrying belt 52 provided on an end part of the development unit by the spiral 51. The waste toner carrying belt 52, for example, includes convex teeth. Concave parts for carrying the toner is formed on the teeth. The toner sent to the waste toner carrying belt 52 is carried to the waste toner carrying spiral 53 along a loop shaped groove. The toner sent to the waste toner carrying spiral 53 is contained in the waste toner collection box 54.

Figure 3:
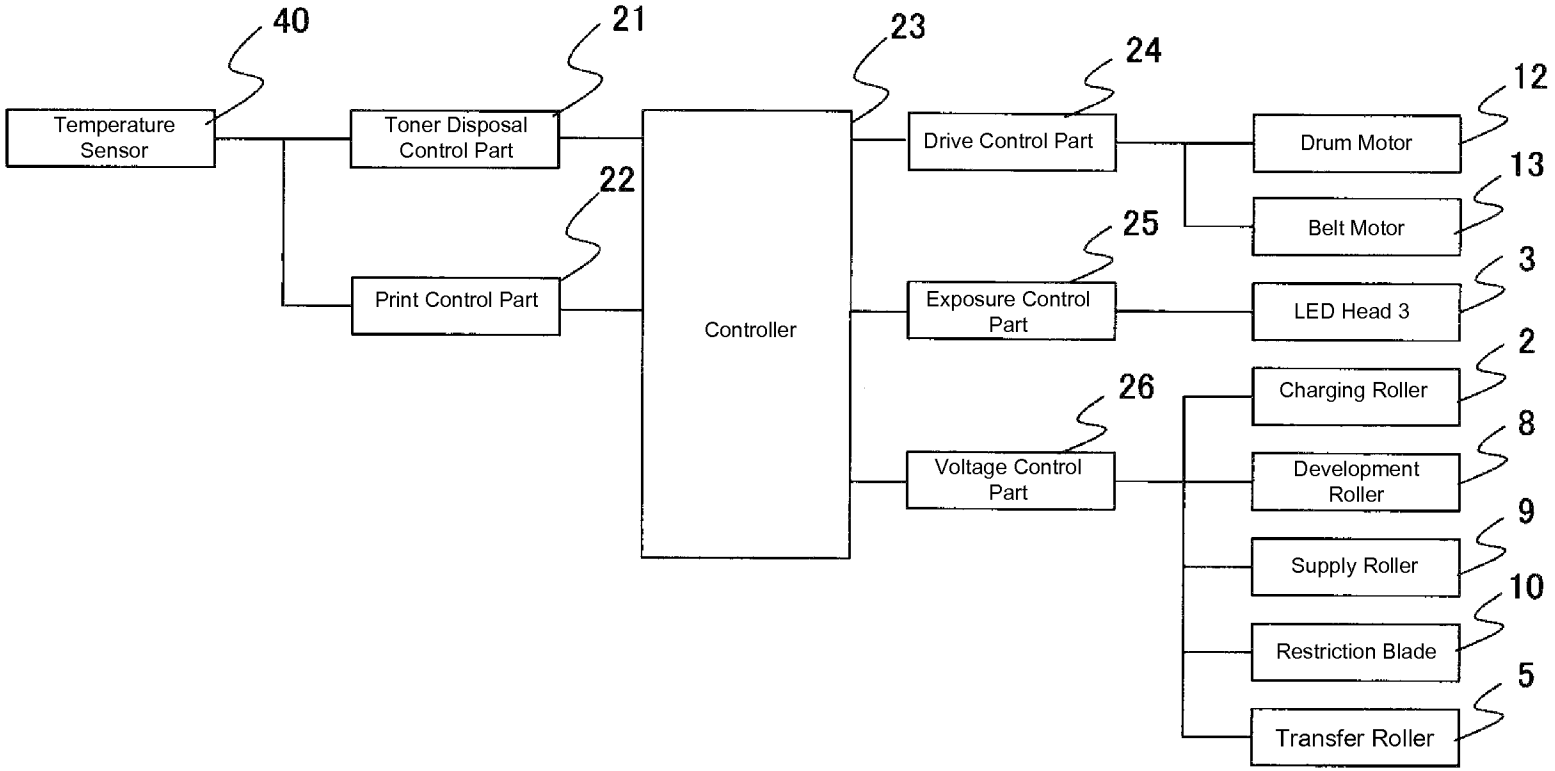
FIG. 3 is a block diagram of the image forming apparatus according to the first embodiment of the present invention.

FIG. 3 is a block diagram of the image forming apparatus according to the present embodiment. The image forming apparatus of the present embodiment is configured with the temperature sensor 40, a toner disposal control part 21, a print control part 22, a controller 23, a drive control part 24, an exposure control part 25, a voltage control part 26, a drum motor 12, a belt motor 13, the LED head 3, the charging roller 2, the development roller 8, the supply roller 9, the restriction blade 10 and the transfer roller 5. The controller 23 is connected to the toner disposal control part 21 and the print control part 22. The toner disposal control part 21 and the print control part 22 are connected to the temperature sensor 40. A detection value of the temperature sensor 40 is used during control of the toner disposal control part 21 and the print control part 22. In addition, the controller 23 is connected to the drive control part 24, the exposure control part 25 and the voltage control part 26. Furthermore, the drive control part 24 is connected to the drum motor 12 and the belt motor 13. The exposure control part 25 is connected to the LED head 3. The voltage control part 26 is connected to the charging roller 2, the development roller 8, the supply roller 9, the restriction blade 10 and the transfer roller 5.

The toner disposal control part 21 is a developer disposal control part that controls disposal of the developer (toner and the like) from the development roller 8 as the developer carrier to the photosensitive drum 1 as the image carrier. The toner disposal control part 21 includes a process function to decide a voltage applied to the transfer member (transfer roller 5) according to a detection value (temperature) of the internal environment detection part (temperature sensor 40) when the dispose of the developer (toner) is performed. The voltage control part 26 includes a process function to control a voltage applied to the transfer member (transfer roller 5) based on the voltage decided by the developer disposal control part (toner disposal control part 21). That is, the toner disposal control part 21 decides the voltage according to the internal environmental temperature. The voltage control part 26 controls the voltage applied to the transfer member based on the voltage according to the internal environmental temperature.

Figure 4:
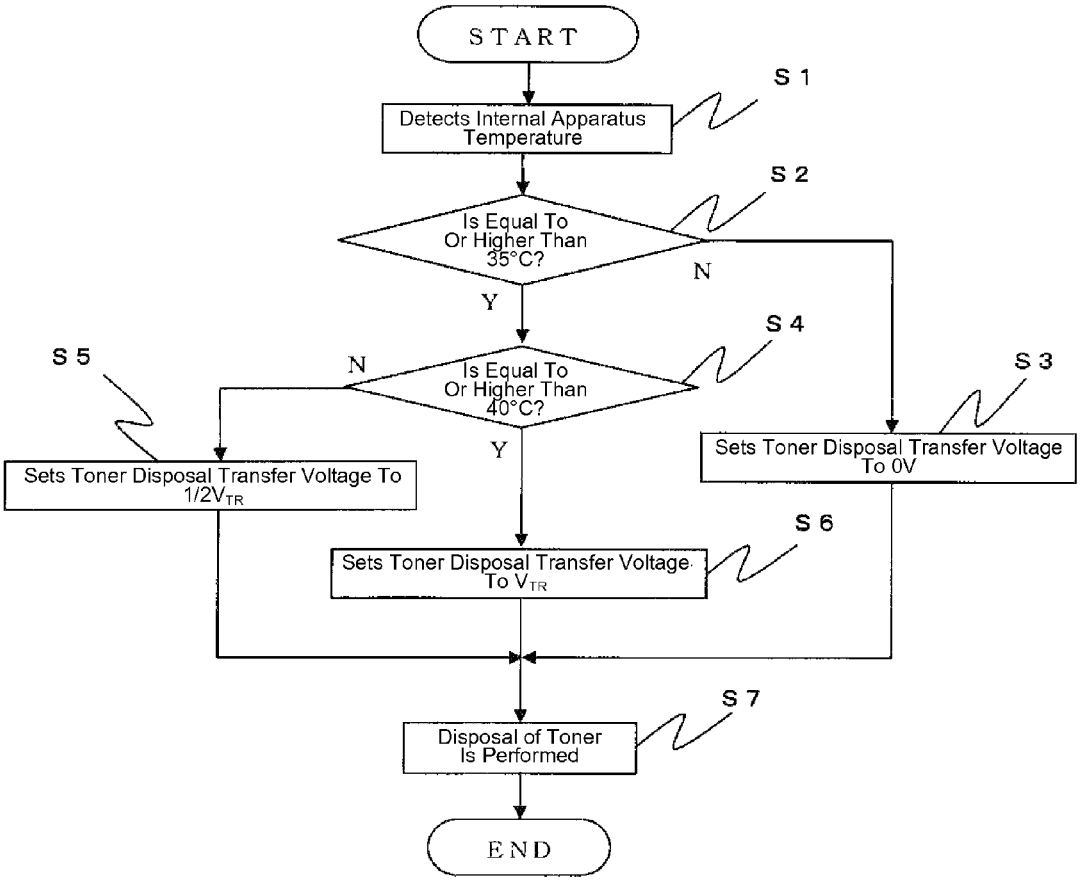
FIG. 4 is a flow diagram of a toner disposal step according to the first embodiment of the present invention.

Specifically, the toner disposal control part 21 includes a process function in a flow diagram in FIG. 4. The print control part 22 is a control part that controls the development unit and the like to perform printing (regular treatment).

The toner disposal control part 21 and the print control part 22 sends an operation instruction to the controller 23 based on the detection value of the temperature sensor 40. The controller 23 determines a printing operation or a toner disposal operation, and controls the drive control part 24, the exposure control part 25 and the voltage control part 26. The drive control part 24 controls the drum motor 12 and the belt motor 13 when the drive control part 24 receives an instruction from the controller 23. The exposure control part 25 controls light emission of the LED head 3 when the exposure control part 25 receives an instruction from the controller 23. The voltage control part 26 controls voltages applied to the charging roller 2, the development roller 8, the supply roller 9, the restriction blade 10, and the voltage applied to the transfer roller 5 when the voltage control part 26 receives an instruction from the controller 23.

[Image Forming Method]

Next, the image forming method according to the present embodiment is explained. The image forming method includes an image forming step and a developer disposal step.

In the image forming step, the development roller 8 supplies the toner on the photosensitive drum 1 that carries the latent image. The transfer roller 5 transfers the toner on the photosensitive drum 1 to the recording medium P or the transfer belt 32. The cleaning blade removes the toner that attaches to the surface of the photosensitive drum 1.

Specifically, the charge voltage is applied to the charging roller 2, and the surface of the photosensitive drum 1 is uniformly charged. After that, the LED head 3 emits light in accordance with an instruction from the exposure control part 25, and the electrostatic latent image pattern is formed on the surface of the photosensitive drum 1. And then, the development voltage is applied to the development roller 8 including a thin toner layer formed on a surface thereof, and the development roller 8 develops the electrostatic latent image pattern on the photosensitive drum 1. The supply voltage having a setting value is applied to the supply roller 9, and the restriction blade voltage having a setting value is applied to the restriction blade 10. The thin toner layer having a uniform thickness is formed on the development roller 8 by the supply roller 9 and the restriction blade 10, and a charge amount of the toner in the thin toner layer is set to a prescribed value.

Next, the transfer voltage is applied to the transfer roller 5, and the drive roller 33 drives. Thereby, the recording medium P is carried to the photosensitive drum 1 by the transfer belt 32. Next, after the toner image on the photosensitive drum 1 has been transferred onto the recording medium P, the toner image on the recording medium P is fixed on the recording medium P by the fuser 7. The recording medium P on which the image is fixed is ejected out of the apparatus by the ejection rollers 31. Thereby, the printing operation is completed. The toner that has not been transferred and remains on the photosensitive drum 1 is removed by the photosensitive body cleaning device 6.

When the image forming apparatus is operated in the normal temperature and humidity environment (22° C., 55%) using negatively charged toner, for example, the voltages are set as follows: the charge voltage is set to −1,050V, the development voltage is set to −200 V, the supply voltage is set to −300 V, and the restriction blade voltage is set to −300 V. The surface of the photosensitive drum 1 is charged when the charge voltage equal to or higher than a prescribed value is applied to the charging roller 2. And then, a surface potential varies with being proportional to the applied charge voltage. When the charge voltage of −1,050 V is applied, the surface potential of −500 V is generated on the surface of the photosensitive drum 1 in the present embodiment. And then, a latent image potential of the latent image pattern formed with the light emitted from the LED head 3 becomes −50 V. The toner supplied from the development roller 8 is attached to the latent image pattern, thereby performing reverse development. When the toner is positively charged, each of the voltages has a reverse property in terms of positive and negative.

Next, the developer disposal step is explained based on the flow diagram in FIG. 4.

In the developer disposal step, the toner disposal control part 21 controls the disposal of the toner from the charging roller 2 to the photosensitive drum 1. The internal environment detection part (temperature sensor 40) detects a physical value (internal temperature) of the environment in the apparatus. The voltage control part 26 controls the voltage applied to the transfer member (transfer roller 5).

Specifically, to form an exposure pattern during the disposal of the toner, a light emission pattern with an area density of 50% density (1, 0, 1, 0 . . . ) is formed in a longitudinal direction of the photosensitive drum 1. A length of the light emission pattern in a rotational direction of the photosensitive drum 1 corresponds to a circumferential length of one rotation of the development roller 8. The transfer voltage during the disposal of toner in a conventional method is set to 0V. Almost all of the waste toner ejected on the photosensitive drum 1 is removed by the photosensitive body cleaning device 6.

Table 2 illustrates generation states of pass-through at a drum count of 30,000 when the transfer voltage is 0V and the disposal of the toner is performed. The drum count is an accumulated value of the rotation number of the photosensitive drum 1, and a drum count of 3 is the rotation number of the photosensitive drum 1 when three sheets of A4 size are continuously printed. To check the pass-through, five toner disposal steps are continuously performed, and misprints on the recording medium P are checked. As a result, no pass-through is generated at the internal apparatus temperature within a range of 10° C-35° C. (equal to or lower than 35° C.), but the pass-through is generated at the internal apparatus temperature of 40° C. or higher.

TABLE 2

| Generation States of Pass-Through (at Drum Count of 30,000) | |
|---|---|
| Internal Apparatus Temperature | Pass-Through |
| 10° C. | ○ |
| 20° C. | ○ |
| 30° C. | ○ |
| 35° C. | ○ |
| 40° C. | x |
| 45° C. | x |
| 50° C. | x |

Therefore, in order to prevent the generation of the pass-through and suppress fog and filming, the transfer voltage is controlled to reduce an amount of waste toner scraped off by the cleaning blade 11 in the present embodiment. That is, the amount of the waste toner scraped off by the cleaning blade 11 is reduced by applying the transfer voltage and by transferring the waste toner to the transfer belt 32 under a condition in which the pass-through easily occurs.

The toner disposal step is specifically explained based on the flow diagram in FIG. 4. Table 3 illustrates transfer voltage values during the disposal of the toner in the image forming method of the present embodiment.

TABLE 3

| Transfer Voltage Values during Disposal of Toner | | |
|---|---|---|
| T < 35° C. | 35° C. ≤ T < 40° C. | 40° C. ≤ T |
| 0 | $\frac{1}{2} \times V_{TR}$ | $V_{TR}$ |

T: Internal Apparatus Temperature
$V_{TR}$: Transfer Voltage during Printing

The temperature sensor 40 detects the internal apparatus temperature (S1). Next, the toner disposal control part 21 determines whether or not the detection value is equal to or higher than 35° C. (S2). When the detection value is lower than 35° C., the toner disposal control part 21 sets the toner disposal transfer voltage to 0V (S3). When the detection value is equal to or higher than 35° C., the toner disposal control part 21 determines whether or not the detection value is equal to or higher than 40° C. (S4). When the detection value is less than 40° C., the toner disposal control part 21 sets the toner disposal transfer voltage to $\frac{1}{2}V_{TR}$ (S5). When the detection value is equal to or higher than 40° C., the toner disposal control part 21 sets the toner disposal transfer voltage to $V_{TR}$ (S6). $V_{TR}$ is a transfer bias during regular printing. $V_{TR}$ is set to $V_{TR}$=+3 kV. In the case, when the toner disposal transfer voltage is 0V, 95-85% of the toner disposed from the development roller 8 to the photosensitive drum 1 remains on the photosensitive drum 1 side and is collected with the cleaning blade 11. In addition, when the toner disposal transfer voltage is $\frac{1}{2}V_{TR}$, 55-40% of the disposed toner is collected with the cleaning blade 11. In addition, when the toner disposal transfer voltage is $V_{TR}$, 20-10% of the disposed toner is collected with the cleaning blade 11.

Next, the voltage control part 26 applies the toner disposal transfer voltage to the transfer roller 5, and the disposal of the toner is performed (S7). When the toner disposal transfer voltage applied to the transfer roller 5 is 0V, almost no waste toner is transferred to the transfer belt 32. When the toner disposal transfer voltage is $\frac{1}{2}V_{TR}$, a certain amount of waste toner is transferred to the transfer belt 32. When the toner disposal transfer voltage is $V_{TR}$, an amount of waste toner is more transferred to the transfer belt 32. The amounts of the transferred waste toner correspond to the amounts of the waste toner that cannot be disposed due to decrease of a function of the photosensitive body cleaning device 6. The waste toner transferred to the transfer belt 32 is collected in the belt cleaning device 35.

Table 4 illustrates generation states of pass-through and filming when the image forming method of the present embodiment is implemented. Favorable results are obtained when the transfer voltages during the disposal of the toner were set to values described below as illustrated in Table 3. That is, when the internal apparatus temperature is less than 35° C., the transfer voltage is set to 0V. When the internal apparatus temperature is equal to or more than 35° C. and less than 40° C., the transfer voltage is set to $\frac{1}{2}V_{TR}$ of the transfer voltage during the printing. When the internal apparatus temperature is equal to or more than 40° C., the transfer voltage is set to $V_{TR}$ of the transfer voltage during the printing. The favorable results regarding the pass-through and the filming are obtained as illustrated in Table 4. The favorable results regarding the filming are obtained since no toner disposal conditions changes at 35° C. at which the filming easily occurs. In addition, the favorable results regarding the pass-through are not affected since no amount of the toner disposed changes.

TABLE 4

Generation States of Pass-Through and Filming (at Drum Count of 30,000)

| Internal Apparatus Temperature | Pass-Through | Filming |
|---|---|---|
| 10° C. | ○ | ○ |
| 20° C. | ○ | ○ |
| 30° C. | ○ | ○ |
| 35° C. | ○ | ○ |
| 40° C. | ○ | ○ |
| 45° C. | ○ | ○ |
| 50° C. | ○ | ○ |

[Effect]

As described above, effects described below are obtained according to the present embodiment.

When temperature in the apparatus rises, Young's modulus of the cleaning blade 11 decreases, and a contact force of the cleaning blade 11 against the photosensitive drum 1 decreases. Thereby, the ability of the cleaning blade 11 to scrape off the toner decreases. Furthermore, the toner softens due to the temperature rise, and an attachment force of the toner to the photosensitive drum 1 becomes large.

Accordingly, the pass-through of the toner easily occurs. In other words, the amount of toner that remains on the photosensitive drum 1 increases.

On the other hand, in the present embodiment, it is possible to prevent the pass-through and to suppress fog and filming since the transfer voltage is adjusted during the disposal of the toner only under the condition in which the pass-through easily occurs, and the amount of the waste toner scraped off by the cleaning blade 11 is reduced.

As a result, it is possible to prevent misprinting on a non-image forming part so that the reliability of the image forming apparatus increases.

Second Embodiment

Next, a second embodiment of the present invention is explained. The image forming apparatus and the image forming method of the present embodiment include the function to transfer waste toner to a transfer side when temperature is high, and include a function to increase an amount of toner transferred to the transfer side when a drum count becomes large. The waste toner collection box 54 of the waste toner collection mechanism of the transfer part is filled when an amount of collected toner in the transfer part increases. Therefore, the amount of toner transferred is reduced when the drum count is small, and the amount of toner transferred is increased as the drum count increases.

[Image Forming Apparatus]

The image forming apparatus according to the present embodiment is explained below. The entire configurations of the image forming apparatus and the waste toner collection mechanism of the present embodiment are almost same as the first embodiment. Here, explanations of the entire configurations are omitted, and characteristics of the present embodiment are mainly explained.

Figure 5:
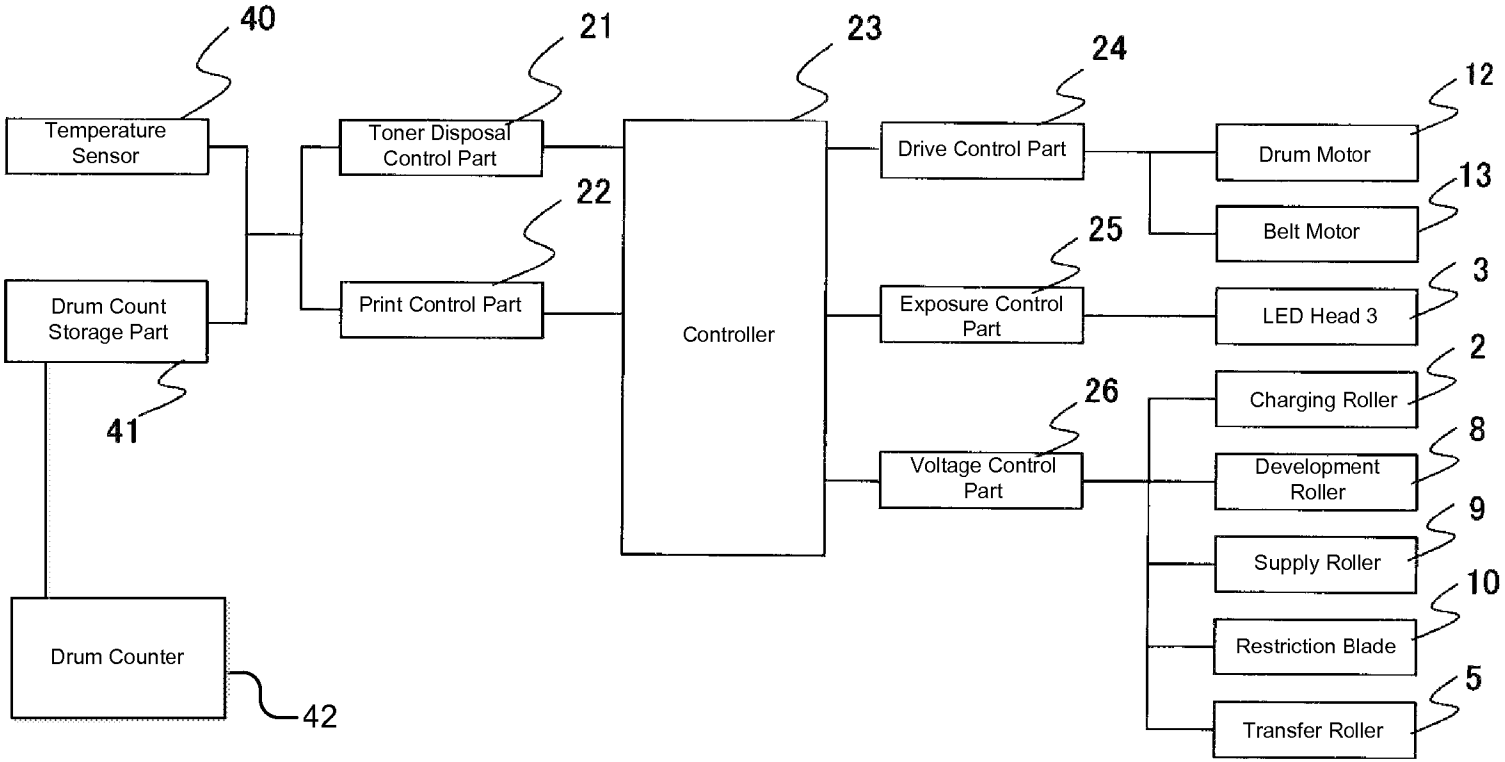
FIG. 5 is a block diagram of the image forming apparatus according to the second embodiment of the present invention.

FIG. 5 is a block diagram of the image forming apparatus according to the present embodiment. The image forming apparatus according to the present embodiment includes the image forming apparatus of the first embodiment, a drum counter 42 as an image carrier rotation number count part and a drum count storage part 41 as an image carrier rotation number storage part. The drum counter 42 counts the rotation number of the photosensitive drum 1. The drum count storage part 41 stores the total rotation number of the photosensitive drum 1 counted by the drum counter 42 as the drum count. The toner disposal control part 21 and the print control part 22 sends an operation instruction to the controller 23 based on the detection value of the temperature sensor 40 and the drum count stored in the drum count storage part 41. The controller 23 determines a printing operation or a toner disposal operation, and controls the drive control part 24, the exposure control part 25 and the voltage control part 26. Thereby, the drive control part 24 controls the drum motor 12 and the belt motor 13 when the drive control part 24 receives an instruction from the controller 23. The exposure control part 25 controls light emission of the LED head 3 when the exposure control part 25 receives an instruction from the controller 23. The voltage control part 26 controls voltages applied to the charging roller 2, the development roller 8, the supply roller 9, the restriction blade 10 and the transfer roller 5 when the voltage control part 26 receives an instruction from the controller 23.

The toner disposal control part 21 includes a process function in flow diagrams in FIGS. 6-9.

[Image Forming Method]

Next, the image forming method according to the present embodiment is explained.

An image forming step is the same as the image forming method of the first embodiment discussed above. Here, explanations are omitted.

The transfer voltage during the disposal of toner is varied according to the internal apparatus temperature and the drum count calculated from the rotation number of the photosensitive drum 1 in the toner disposal step of the present embodiment. The toner disposal step is explained based on the flow diagrams in FIGS. 6-9. Table 5 illustrates transfer voltage values during the disposal of the toner in the image forming method of the present embodiment.

TABLE 5

Transfer Voltage Values during Disposal of Toner

| | T < 35° C. | 35° C. ≤ T < 40° C. | 40° C. ≤ T |
|---|---|---|---|
| D < 20,000 | 0 | $\frac{1}{3} \times V_{TR}$ | $\frac{1}{2} \times V_{TR}$ |
| D ≤ 20,000 < 25,000 | 0 | $\frac{1}{2} \times V_{TR}$ | $\frac{2}{3} \times V_{TR}$ |
| 25,000 ≤ D | $\frac{1}{2} \times V_{TR}$ | $\frac{2}{3} \times V_{TR}$ | $V_{TR}$ |

Figure 6:
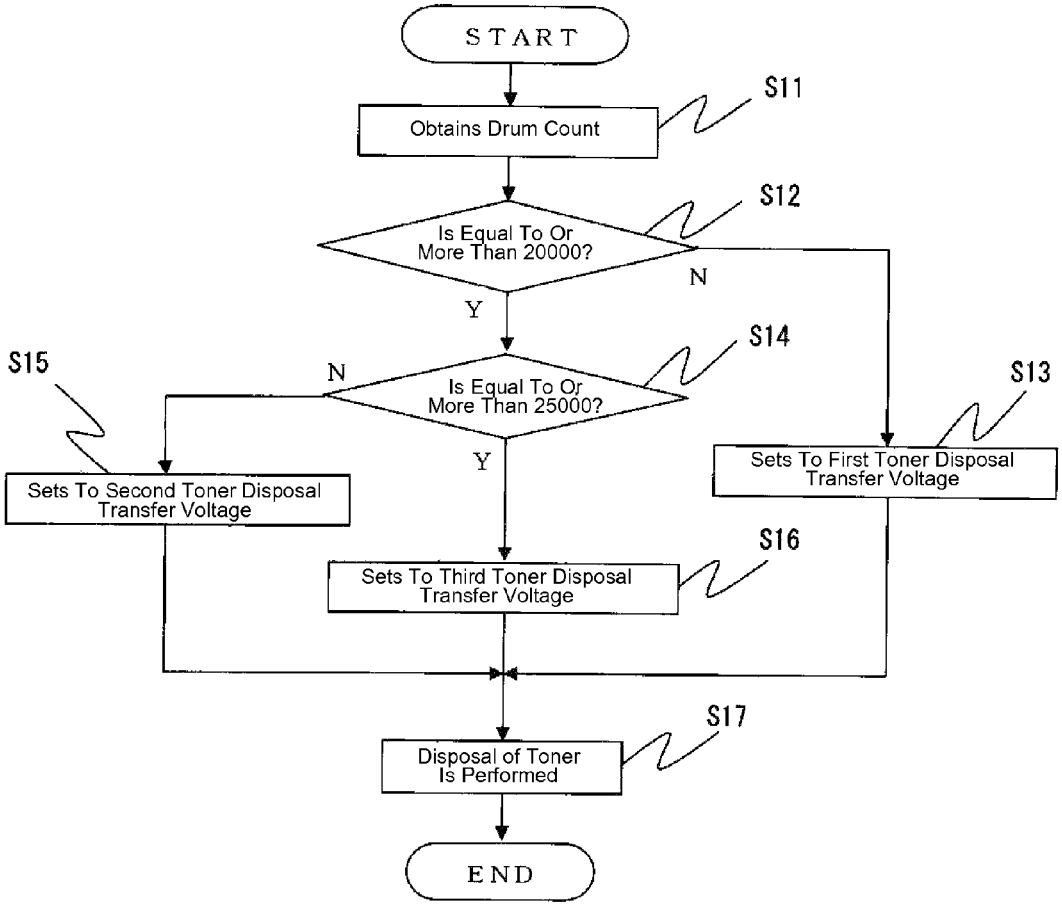
FIG. 6 is a flow diagram of a toner disposal step according to the second embodiment of the present invention.

T: Internal Apparatus Temperature
$V_{TR}$: Transfer Voltage during Printing
D: Drum Count As illustrated in FIG. 6, the toner disposal control part 21 obtains the drum count stored in the drum count storage part 41 (S11). Next, the drum count storage part 41 determines whether or not the drum count is equal to or more than 20,000 (S12). When the drum count is less than 20,000, the voltage control part 26 sets the toner disposal transfer voltage to a first toner disposal transfer voltage (S13). The first toner disposal transfer voltage setting process is discussed later. When the drum count is equal to or more than 20,000, the drum count storage part 41 determines whether or not the drum count is equal to or more than 25,000 (S14). When the drum count is less than 25,000, the voltage control part 26 sets the toner disposal transfer voltage to a second toner disposal transfer voltage (S15). The second toner disposal transfer voltage setting process is discussed later. When the drum count is equal to or more than 25,000, the voltage control part 26 sets the toner disposal transfer voltage to a third toner disposal transfer voltage (S16). The third toner disposal transfer voltage setting process is discussed later.

Next, the voltage control part 26 respectively applies appropriate voltages of the toner disposal transfer voltages to the transfer rollers 5, and the disposal of the toner is performed (S17).

Figure 7:
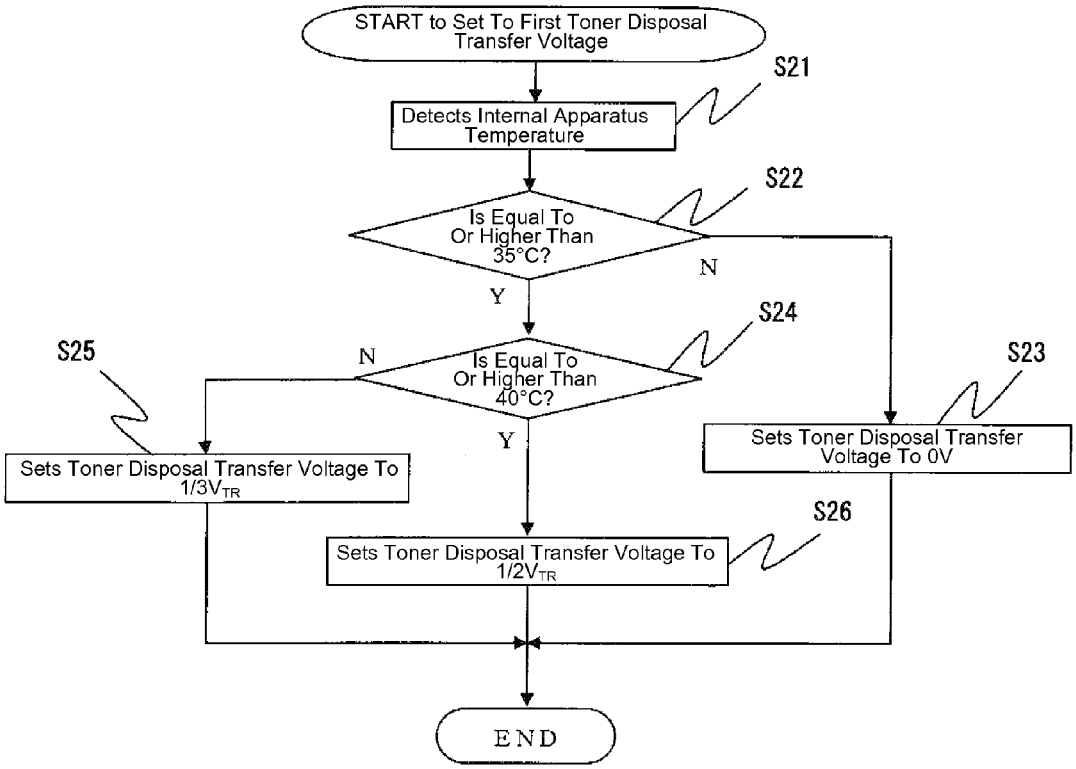
FIG. 7 is a flow diagram of a first toner disposal transfer voltage setting process step.

FIG. 7 illustrates the first toner disposal transfer voltage setting process. The temperature sensor 40 detects the internal apparatus temperature (S21). Next, the controller 23 determines whether or not the detection value is equal to or higher than 35° C. (S22). When the detection value is lower than 35° C., the voltage control part 26 sets the toner disposal transfer voltage to 0V (S23). When the detection value is equal to or higher than 35° C., the controller 23 determines whether or not the detection value is equal to or higher than 40° C. (S24). When the detection value is less than 40° C., the voltage control part 26 sets the toner disposal transfer voltage to $\frac{1}{3}V_{TR}$ (S25). When the detection value is equal to or higher than 40° C., the voltage control part 26 sets the toner disposal transfer voltage to $\frac{1}{2}V_{TR}$ (S26).

Figure 8:
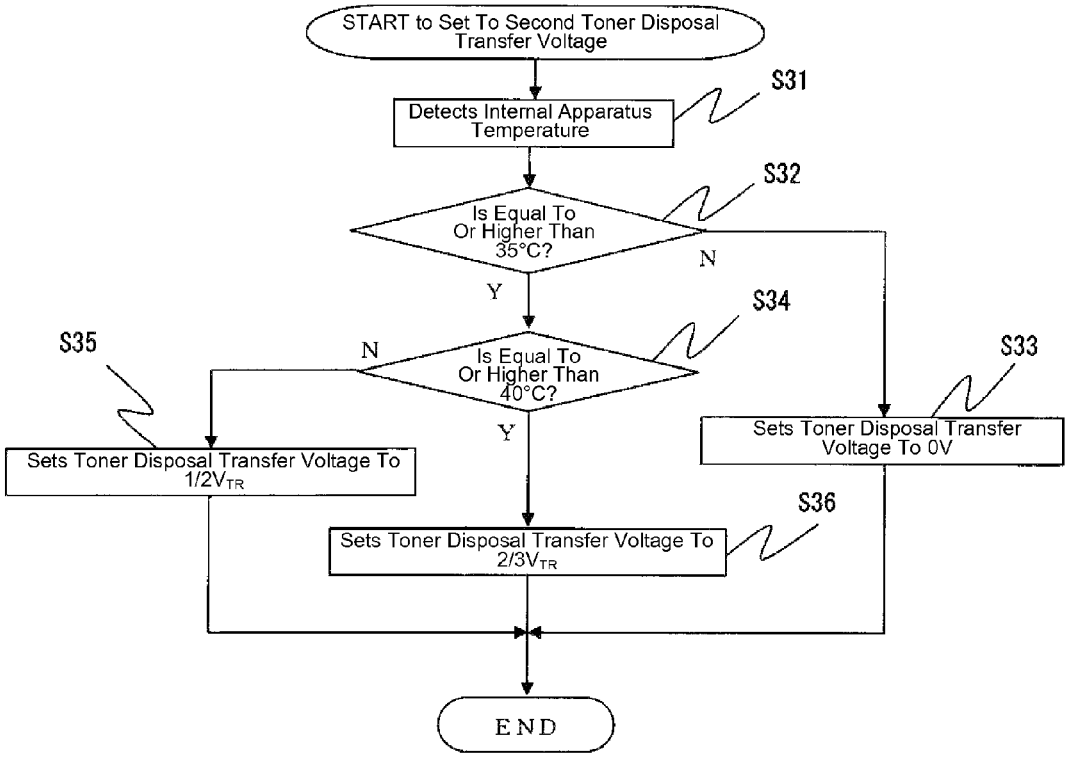
FIG. 8 is a flow diagram of a second toner disposal transfer voltage setting process step.

FIG. 8 illustrates the second toner disposal transfer voltage setting process. The temperature sensor 40 detects the internal apparatus temperature (S31). Next, the controller 23 determines whether or not the detection value is equal to or higher than 35° C. (S32). When the detection value is lower than 35° C., the voltage control part 26 sets the toner disposal transfer voltage to 0V (S33). When the detection value is equal to or higher than 35° C., the controller 23 determines whether or not the detection value is equal to or higher than 40° C. (S34). When the detection value is less than 40° C., the voltage control part 26 sets the toner disposal transfer voltage to $\frac{1}{2}V_{TR}$ (S35). When the detection value is equal to or higher than 40° C., the voltage control part 26 sets the toner disposal transfer voltage to $\frac{2}{3}V_{TR}$ (S36).

Figure 9:
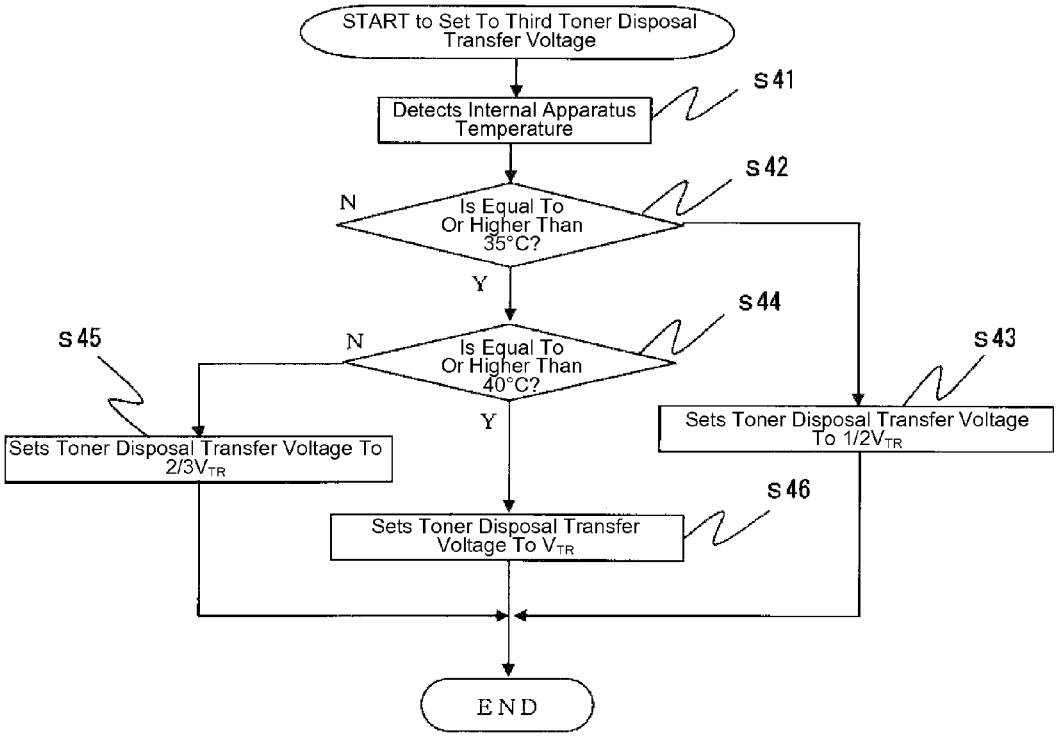
FIG. 9 is a flow diagram of a third toner disposal transfer voltage setting process step.

FIG. 9 illustrates the third toner disposal transfer voltage setting process. The temperature sensor 40 detects the internal apparatus temperature (S41). Next, the controller 23 determines whether or not the detection value is equal to or higher than 35° C. (S42). When the detection value is lower than 35° C., the voltage control part 26 sets the toner disposal transfer voltage to $\frac{1}{2}V_{TR}$ (S43). When the detection value is equal to or higher than 35° C., the controller 23 determines whether or not the detection value is equal to or higher than 40° C. (S44). When the detection value is less than 40° C., the voltage control part 26 sets the toner disposal transfer voltage to $\frac{2}{3}V_{TR}$ (S45). When the detection value is equal to or higher than 40° C., the voltage control part 26 sets the toner disposal transfer voltage to $V_{TR}$ (S46).

The amounts of the transferred waste toner correspond to the amounts of the waste toner that cannot be disposed due to decrease of a function of the photosensitive body cleaning device 6.

[Effects]

As described above, the same effects as those of the first embodiment discussed above are obtained according to the present embodiment. Furthermore, it is possible to reduce a capacity of the belt cleaning device 35 since the waste toner is collected with the transfer belt 32 only under a drum count and an internal apparatus temperature at which the pass-through is generated.

The temperature of the transfer belt 32 (internal apparatus temperature) and the rotation number of the photosensitive drum 1 are used as the physical values in the embodiments. All factors that decrease the cleaning ability of the photosensitive body cleaning device 6 are used.

In each of the embodiments, the transfer voltage applied to the transfer roller 5 and the rotation number of the photosensitive drum 1 are controlled by separating into the three stages. However, since the cleaning ability of the photosensitive body cleaning device 6 varies according to the various conditions such as specifications of the photosensitive drum 1, the cleaning blade 11, toner and the like, ambient temperature, and the like, the number of the stages may be appropriately modified according to the conditions. Specifically, the transfer voltage and the rotation number are controlled by separating into two or four or more stages. In addition, if the relationship (proportional relationship and the like) between variation of the physical values such as temperature and the like and variation of the cleaning ability is clear, the transfer voltage and the rotation member may continuously be controlled in accordance with the relationship.

The present invention is explained with a printer. However, the present invention may be implemented in a photocopy apparatus, a facsimile machine and a multi function peripherals (MFP).

The present invention is not limited to the embodiments, but may be appropriately modified without departing from the scope of the embodiments. The temperature of the transfer belt 32 is used in the first embodiment, and the temperature of the transfer belt 32 and the rotation number of the photosensitive drum 1 is used in the second embodiment so that the amount of toner transferred to the transfer belt is controlled, for example. However, the toner transferred to the transfer belt may be controlled only by using the rotation number of the photosensitive drum 1. Specifically, the toner disposal control part 21 may set a plurality of internal environmental temperatures for decision of a voltage, and decide a voltage according to each of the internal environmental temperatures. The voltage control part 26 may control a voltage applied based on each of the voltages at a plurality of stages. In addition, the toner disposal control part 21 may set a plurality of the total rotation numbers of the photosensitive drum 1 for decision of a voltage, and decide a voltage according to each of the total rotation numbers. The voltage control part 26 may control a voltage applied based on each of the voltages at a plurality of stages.

What is claimed is:

1. An image forming apparatus, comprising:

an image carrier configured to carry a latent image;

a developer carrier configured to supply developer on the image carrier;

a transfer part configured to transfer the developer on the image carrier;

a cleaning blade configured to remove attachment that attaches to a surface of the image carrier;

an internal environment detection part configured to detect an internal environmental temperature in the apparatus;

a developer disposal control part configured to control disposal of developer from the developer carrier to the image carrier; and a voltage control part configured to control an applied voltage to the transfer part, wherein the transfer part includes a belt configured to hold a developer image on a surface thereof and a transfer cleaning member configured to remove the developer that attaches onto the belt, the developer disposal control part determines an absolute value of the applied voltage larger, which is applied to the transfer part during disposing the developer, where the internal environment temperature is high in comparison with where the internal environment temperature is low, the voltage control part controls the applied voltage to the transfer part based on the absolute value of the voltage decided by the developer disposal control part.

2. The image forming apparatus according to claim 1, wherein the voltage control part causes the applied voltage, which is determined by the voltage control part, to be applied to the transfer part.

3. The image forming apparatus according to claim 1, further comprising:

an image carrier rotation number count part configured to count a rotation number of the image carrier, an image carrier roation number storage part configured to store the total rotation number counted by the image carrier rotation number count part, wherein the developer disposal control part determines the absolute value of the applied voltage to the transfer part during disposing the developer according to the total rotation number of the image carrier.

4. The image forming apparatus according to claim 3, wherein where the total rotation number of the image carrier is large, the developer disposal control part sets the absolute value of the applied voltage higher in comparison with where the total rotation number of the image carrier is small.

5. The image forming apparatus according to claim 1, wherein the toner disposal control part configured to store a plurality of internal environmental temperatures for the determination of the applied voltage, and to respectively determine voltages in correspondence with the internal environmental temperatures, the voltage control part configured to control the applied voltage based on each of the voltages so that the applied voltage varies in several stages.

6. The image forming apparatus according to claim 3, wherein the toner disposal control part configured to store a plurality of total rotation numbers of the image carrier, and to respectively determine voltages in correspondence with each of the total rotation numbers, the voltage control part configured to control the applied voltage based on each of the voltages so that the applied voltage varies in several stages.

7. An image forming method, comprising:

a developing process in which developer is supplied to an image carrier, which carries a latent image, from a developer carrier that carries the developer and faces the image carrier so that the latent image is developed and turned into a developed image, a transferring process in which the developed image is transferred from the image carrier to a recording medium that is carried by a transfer part that faces the image carrier, a fusing process in which that developed image that was transferred to the recording medium is fused by heat and pressure on the recording medium, and a disposing process in which the developer is disposed from the developer carrier to the image carrier, the disposing process including:

detecting internal apparatus temperature in an apparatus;

determining an absolute value of a voltage, which is applied to the transfer part, larger when the internal environment temperature is high in compatison with the internal environment temperature is low, applying the voltage to the transfer part, which is determined based on the absolute value of the voltage.

8. The image forming method according to claim 7, wherein the disposing process further includes obtaining a rotation number of the image carrier.

9. The image forming apparatus according to claim 1, wherein the developer is toner of which an attachment force to the image carrier varies according to temperature; and the developer disposal control part determines the absolute value of the applied voltage further considering Young module of the cleaning blade and the attachment force of the toner.

10. The image forming apparatus according to claim 1, wherein the cleaning blade is arranged in contact with the surface of the image carrier, and the voltage control part increases the absolute value of the applied voltage to the transfer part so that an amount of the attachment, which reaches the cleaning blade, decreases.

11. An image forming apparatus, comprising:

an image carrier configured to carry a latent image;

a developer carrier configured to supply developer on the image carrier so the latent image is developed by the developer, becoming a developed image;

a transfer part configured to transfer the developed image on the image carrier to a recording medium that is carried along the transfer part;

a cleaning blade configured to remove attachment that attaches to a surface of the image carrier;

an internal environment detection part configured to detect an internal environmental temperature in the apparatus;

a developer disposal control part configured to control disposal of developer from the developer carrier to the image carrier; and a voltage control part configured to control an applied voltage to the transfer part, wherein the developer disposal control part determines an absolute value of the applied voltage, which is applied to the transfer part during the disposal of developer, larger where the internal environment temperature is high in comparison with where the internal environment temperature is low.

12. The image forming apparatus according to claim 11, wherein the toner disposal control part configured to store a plurality of internal environmental temperatures for the determination of the applied voltage, and to respectively determine voltages in correspondence with the internal environmental temperatures, the voltage control part configured to control the applied voltage based on each of the voltages so that the applied voltage varies in several stages.

13. The image forming apparatus according to claim 11, wherein the developer is toner of which an attachment force to the image carrier varies according to temperature; and the developer disposal control part determines the absolute value of the applied voltage further considering Young module of the cleaning blade and the attachment force of the toner.

14. The image forming apparatus according to claim 11, wherein the voltage control part increases the absolute value of the applied voltage to the transfer part so that an amount of the attachment on the image carrier decreases.

15. The image forming apparatus according to claim 11, further comprising:

an image carrier rotation number count part configured to count a rotation number of the image carrier, an image carrier rotation number storage part configured to store the total rotation number counted by the image carrier rotation number count part, wherein the developer disposal control part determines the absolute value of the applied voltage to the transfer part considering the total rotation number of the image carrier in addition to the internal environment temperature.

* * * * *